US005400437A

United States Patent [19]

Koutras

[11] Patent Number: 5,400,437

[45] Date of Patent: Mar. 28, 1995

[54] BANNER PONCHO COMBINATION

[76] Inventor: Leigh M. Koutras, Silivrias 22, Sepolta 10443, Athens, Greece

[21] Appl. No.: 188,775

[22] Filed: Jan. 31, 1994

[51] Int. Cl.[6] ..... A41D 1/00

[52] U.S. Cl. ..... 2/84; 2/69; 2/1; 2/115; 40/586; 116/173

[58] Field of Search ..... 2/1, 84, 46, 69, 69.5, 2/88, 115, 255, 256, 271; 40/586, 603, 604, 218; 116/173

[56] References Cited

U.S. PATENT DOCUMENTS 2,093,889 9/1937 Horn .
2,109,951 3/1938 Truesdell et al. ..... 2/84
2,412,415 12/1946 Navon .
3,042,931 7/1962 SAwyer .
4,370,755 2/1983 Crumby .
4,466,136 8/1984 Bottom et al. ..... 2/1
4,752,971 6/1988 Meserol .

*Primary Examiner*—Clifford D. Crowder
*Assistant Examiner*—Gloria Hale

[57] ABSTRACT

A combination banner and poncho is shown consisting of a flexible plastic envelope with a staff attached to one edge, the envelope having an emblazed logo or the like, for waving over one's head at a sporting event, rally or the like. The device can be worn as a poncho if desired during inclement weather.

16 Claims, 2 Drawing Sheets

BANNER PONCHO COMBINATION

BACKGROUND OF THE INVENTION

1. Field Of The Invention

The invention herein pertains to a flag or banner which may display advertising, a slogan, or a school logo such as for team sports, which is convertible to a poncho for wear during inclement weather.

2. Description Of The Prior Art And Objectives Of The Invention

Flags and banners have been popular for years for displaying advertising slogans, team emblems, company logos and the like. Such banners are usually attached to a pole or staff for manually waving high in the air at ball games, rallies and other events.

Ponchos have been popular for years to help ward off weather elements in inclement weather when one is forced to work, play or remain outdoors. Spectators at ball games, rallies and the like often do not wish to leave an event merely because inclement weather arrives. Thus, ponchos, raincoats and other such gear are often worn. Umbrellas are sometimes not allowed in stadiums, bleachers and the like at sporting events due to their tendency to obstruct the view of other spectators seated or standing behind the user.

With the problems and inconvenience of conventional protective weather gear, the present invention was conceived in part to combine the characteristics and advantages of both slogan-displaying banners and rain-proof ponchos into a single, easily transportable device which serves dual uses and it is therefore an objective of the present invention to provide a banner which can be converted to form a poncho when required.

It is yet another objective of the present invention to provide a banner which displays a slogan, team emblem or the like.

It is yet another objective of the present invention to provide a banner which has a staff attached for waving at a ball game, rally or the like.

It is another objective of the present invention to provide a banner which is convertible into a poncho made of a waterproof material.

It is still another objective of the present invention to provide a banner which is convertible into a poncho which includes a hood for protection of one's head.

It is also an objective of the present invention to provide a banner which is convertible into a poncho which can be compactly rolled and easily transported.

Various other objectives and advantages of the present invention will become apparent to those skilled in the art as a more detailed description is set forth below.

SUMMARY OF THE INVENTION

The aforesaid and other objectives are realized by providing an envelope composed of a lightweight, flexible polymeric material such as a polyethylene plastic which can be used to display any of a variety of emblems, logos, slogans or the like on its outer surfaces. The banner poncho combination has a staff attached to one side of the envelope for use in waving at a game, rally or the like. The combination is easily convertible into a poncho as it provides an internal pocket between front and back layers of the envelope for one's body and has arm holes on either end. A hood is located at the top, adjacent to a head opening, for protection of the wearer's head during inclement weather. The envelope is easily rolled around the staff into an elongated, compact shape for ease in transporting and storage. When worn as a poncho, the staff hangs behind the wearer's arm, out of the way, or the staff can be completely removed if necessary.

DESCRIPTION OF THE PREFERRED EMBODIMENT

Figure 1:
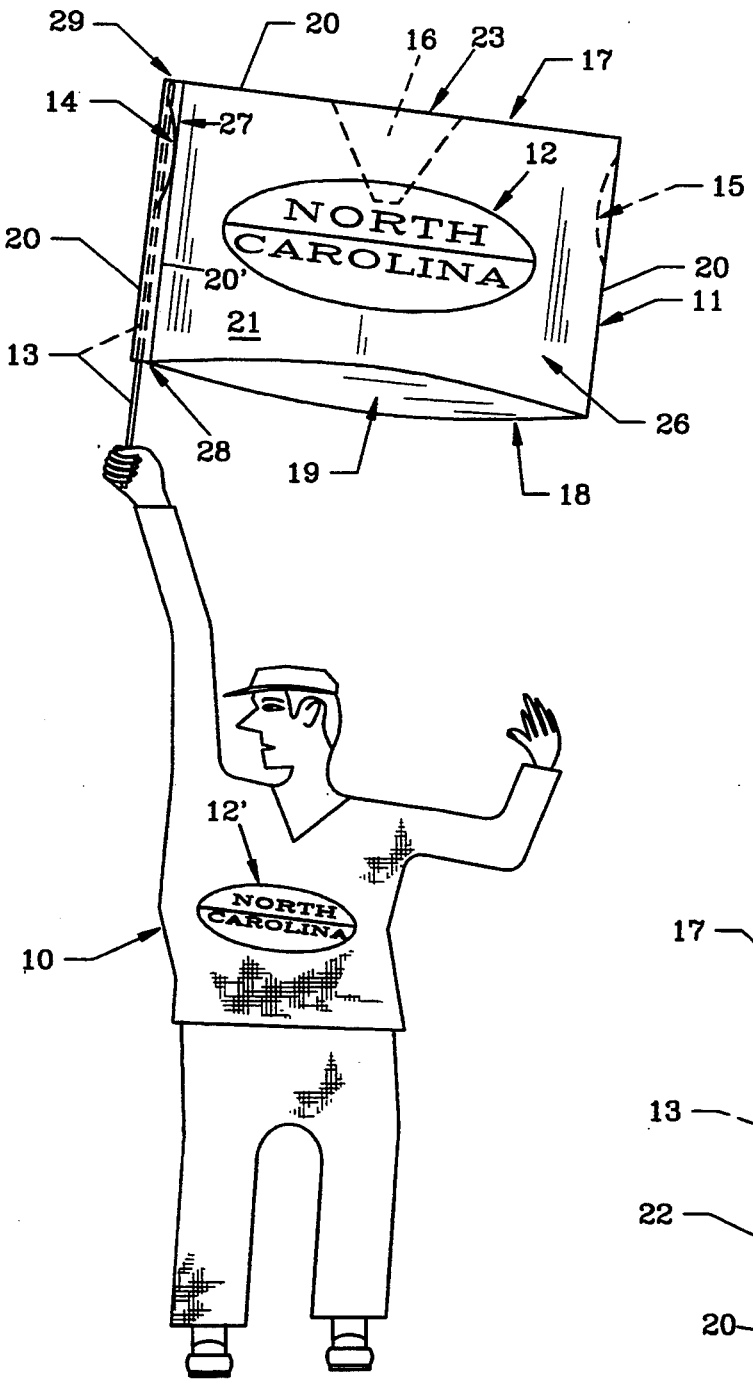
FIG. 1 illustrates the invention being used as a banner, being waved over a sports fan's head.
Figure 4:
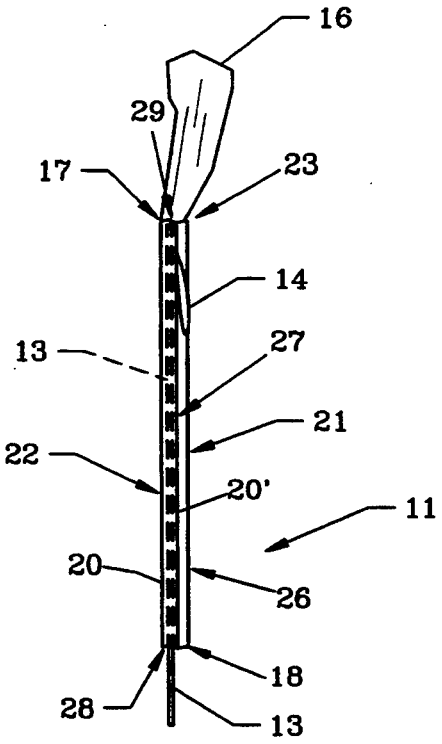
FIG. 4 shows an elevational right side view of the invention with its hood extended but removed from a wearer's body.
Figure 2:
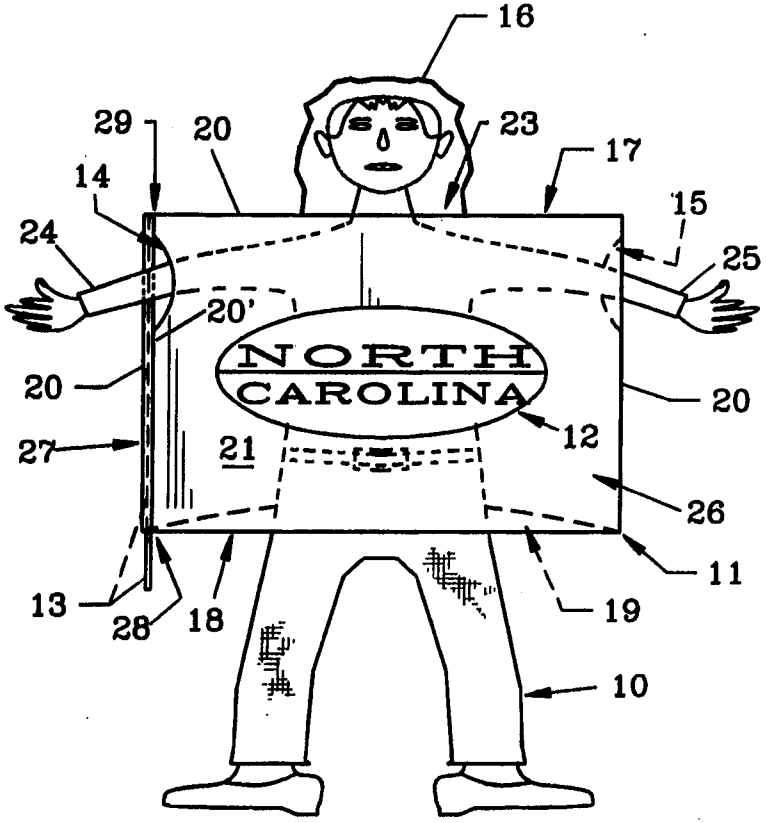
FIG. 2 depicts the invention in use as a poncho over the fan's head and body during inclement weather.

The preferred form of the invention is shown in FIGS. 1, 2 and 4 wherein a banner poncho combination is formed from an envelope of thin, waterproof material, such as polyethylene plastic, attached to a flexible staff. The plastic envelope has an emblazed logo, slogan, or team emblem which can be used during ball games, rallies, etc. The invention as shown in FIG. 1 is being used as a team banner and is being waved by a fan wearing a similar team logo. The invention shown in FIG. 2 is used by the fan after inclement weather has dampened the activity which the spectator is observing. This combination shown in FIG. 2 covers the spectator's head, body and arms to ward off elements such as rain, sleet or snow, keeping the spectator dry, yet allows the spectator to display school or team spirit by the emblazed logo. The staff, which is used to wave the banner high, conveniently hangs out of the way behind the spectator's right arm when the invention is worn as a poncho. When the invention is being used as a banner, the hood can be tucked inside the interior of the plastic envelope. When inclement weather strikes, and the banner is worn as a poncho, the hood can be pulled out for use over the wearer's head. Arm holes near the top of the banner poncho combination provide means for a spectator to extend his arms and hands exteriorly of the poncho. The invention is preferably composed of thin sheets of conventional polyethylene plastic, sized to fit many as it measures approximately four feet in width by three feet in height. The staff preferably extends approximately one foot from the bottom of the envelope to provide a handle for waving the invention. The edge joints of the envelope may be sealed by heat or adhesives, preferably heat, for creating a waterproof, tight joint.

DETAILED DESCRIPTION OF THE DRAWINGS AND OPERATION OF THE INVENTION

For a better understanding of the invention, turning now to the drawings, FIG. 1 illustrates fan 10 using banner poncho combination 11 as a banner, waving it in the air above his head. Banner poncho combination 11 consists of lightweight, flexible envelope 26 removably attached to lightweight flexible staff 13. As can been seen, banner poncho combination 11 has logo 12 on its front layer 21. Fan 10, wearing similar logo 12' on his clothing, is holding banner poncho combination 11 by staff 13 which extends along the right side of envelope 26. As can been seen in this figure, hood 16 is tucked inside envelope 26 proximate head opening 23. The joints 20,20' on edges of envelope 26 are heat sealed to give strength to joints 20,20' and prevent water from leaking into interior 19. As can been seen, bottom 18 is open, providing an entrance for fan 10 to fit therein upon threat of inclement weather.

During rain, etc., fan 10 can place banner poncho 11 over himself as shown in FIG. 2 for protection. As can be seen fan 10 can extend his right arm 24 through right arm opening 14 and can also extend his left arm 25 through left arm opening 15. Fan 10 can extend his head through head opening 23 centrally located in top 17 of envelope 26. Hood 16 can also be worn for protection. Banner poncho combination 11 can now be worn by fan 10 to continue displaying logo 12 with whatever slogan, logo or team emblem he desires. Staff 13 hangs out of the way behind right arm 24 as the top 17 of banner poncho combination 11 rests upon the shoulders of fan 10.

Figure 3:
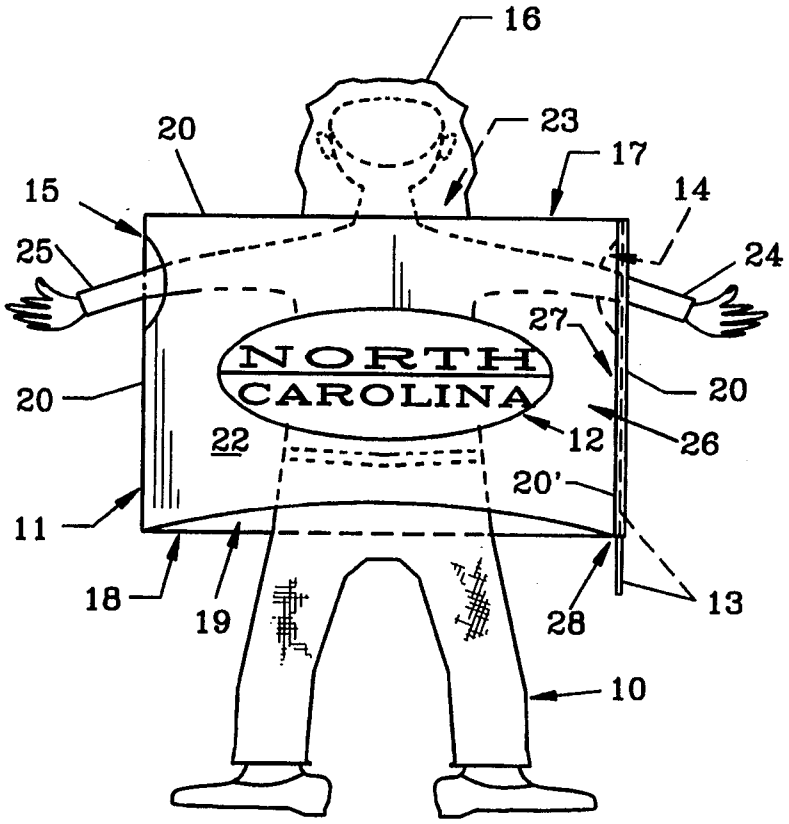
FIG. 3 shows a rear view of the invention being used as a poncho.

FIG. 3 shows a rear view of fan 10, as shown in FIG. 2, wearing banner poncho combination 11 as a poncho for protection from rain or the like. Here logo 12 is shown on the rear layer 22 of banner poncho 11. Staff 13 is shown behind right arm 24 where it is out of the way.

A right side elevational view of banner poncho combination 11 is shown in FIG. 4, as removed from the person. Hood 16 is presented extended from top 17 of banner poncho combination 11. Staff channel 27 is shown at right edge of envelope 26 between joints 20, 20' as may be created by heat sealing or adhesive. Staff 13, which is a cylindrically-shaped rod, extends through staff channel opening 28 at envelope bottom 18, into staff channel 27, and up to closed staff channel end 29. Staff 13 can be slidably removed from staff channel 27 if desired. As shown in FIGS. 2 and 3, staff channel 27 is located rearwards of right arm opening 14 so that when in place inside staff channel 27, staff 13 will hang out of the way behind the right arm 24 of fan 10 wearing banner poncho 11. In FIG. 4, right arm opening 14 can be seen frontward of staff 13 while front layer 21 and rear layer 22 are shown flat, as unworn.

Figure 5:
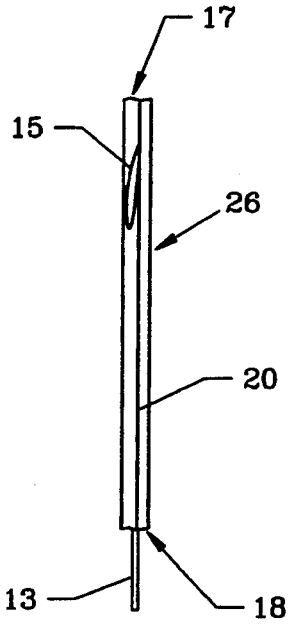
FIG. 5 depicts the invention rolled around the staff for storage.

The compactness and ease of transporting banner poncho 11 is shown by FIG. 5, which demonstrates a rolled configuration. Envelope 26 is rolled around staff 13 into a thin, tubular shape with left arm opening 15 now seen on the outer surface.

The illustrations and examples provided herein are for explanatory purposes and are not intended to limit the scope of the appended claims.

I claim:

1. A banner poncho combination comprising: a flexible envelope, said envelope defining a staff channel, a staff, said staff positioned within said staff channel, said envelope defining an arm opening, a body opening and a head opening whereby said envelope can be worn.

2. The banner poncho combination of claim 1 wherein said envelope comprises front and rear layers, said front and said rear layers formed from a flexible material and having edges, said front and said rear sections joined along said edges.

3. The banner poncho combination of claim 1 wherein said envelope defines a staff channel opening, said staff channel opening in communication with said staff channel.

4. The banner poncho combination of claim 1 wherein said envelope is formed from a polymeric substance.

5. The banner poncho combination of claim 1 and including a hood, said hood attached to said envelope proximate said head opening.

6. The banner poncho combination of claim 5 wherein said hood is foldable within said head opening.

7. The banner poncho combination of claim 1 wherein said staff comprises a cylindrically shaped rod.

8. The banner poncho combination of claim 1 wherein said staff is flexible.

9. The banner poncho combination of claim 3 wherein said staff channel is proximate said arm opening.

10. The banner poncho combination of claim 1 wherein said staff extends beyond said envelope.

11. A banner poncho combination which can be worn or removed and waved comprising: a flexible envelope, said envelope having front and rear sections, said sections having edges, said sections joined along said edges, said envelope defining a body opening, a head opening, a pair of arm openings, a staff channel, and a staff channel opening, a staff, said staff for insertion through said staff channel opening and into said staff channel, said envelope wrappable around said staff for storage purposes.

12. The banner poncho combination of claim 11 wherein said envelope is formed from a polymeric material.

13. The banner poncho combination of claim 12 wherein said polymeric material is polyethylene.

14. The banner poncho combination of claim 12 wherein said staff is flexible.

15. The banner poncho combination of claim 12 wherein said staff is formed from plastic.

16. The banner poncho combination of claim 12 wherein said staff extends beyond said envelope.

* * * * *